US006187490B1

(12) United States Patent
Taya et al.

(10) Patent No.: US 6,187,490 B1
(45) Date of Patent: Feb. 13, 2001

(54) RESIN-COATED CARRIER, TWO-COMPONENT DEVELOPER AND IMAGE FORMING METHOD

(75) Inventors: Masaaki Taya; Takaaki Kohtaki, both of Mishima; Yasuhiro Ichikawa, Suntoh-gun, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/526,473

(22) Filed: Mar. 15, 2000

(30) Foreign Application Priority Data

Mar. 15, 1999 (JP) ..... 11-067898

(51) Int. Cl.[7] ..... G03G 13/01; G03G 13/09; G03G 9/107; G03G 9/113

(52) U.S. Cl. ..... 430/45; 430/102; 430/106.6; 430/108; 430/122

(58) Field of Search ..... 430/45, 106.6, 430/108, 102, 122

(56) References Cited

U.S. PATENT DOCUMENTS

| | | | | |
|---|---|---|---|---|
| 4,898,801 | * | 2/1990 | Tachibana et al. | 430/106.6 |
| 5,595,850 | * | 1/1997 | Honjo et al. | 430/108 |
| 5,795,673 | * | 8/1998 | Okado et al. | 430/106.6 |
| 5,858,597 | | 1/1999 | Mizoh et al. | 430/110 |
| 5,976,747 | * | 11/1999 | Sato et al. | 430/108 |
| 6,026,260 | * | 2/2000 | Aita et al. | 430/106.6 |

FOREIGN PATENT DOCUMENTS

| | | |
|---|---|---|
| 47-13954 | 7/1972 | (JP) . |
| 55-127569 | 10/1980 | (JP) . |
| 56-32149 | 4/1981 | (JP) . |
| 60-208765 | 10/1985 | (JP) . |
| 60-208767 | 10/1985 | (JP) . |
| 8-22150 | 1/1996 | (JP) . |
| 8-6302 | 1/1996 | (JP) . |
| 8-69185 | 3/1996 | (JP) . |

* cited by examiner

*Primary Examiner*—Roland Martin
(74) *Attorney, Agent, or Firm*—Fitzpatrick, Cella, Harper & Scinto

(57) ABSTRACT

A two-component developer suitable for electrophotography is formed of a toner and a resin-coated carrier. The resin-coated carrier is formed of carrier core particles and 0.01–2.0 wt. % based on the carrier core particles of a resin coating layer coating the carrier core particles. The resin-coated carrier has an average particle size of 25–55 $\mu$m and the carrier core particles comprise a ferrite component represented by formula (I) below:

$$(Fe_2O_3)_a(MnO)_b(MgO)_c(A)_d \quad (I),$$

wherein A represents a mixture of SrO, CaO and $Al_2O_3$, and a, b, c and d are numbers representing mol fractions of associated components and satisfying: $0.4<a<0.6$, $0.35<b<0.45$, $0.07<c<0.12$, $0.005<d<0.015$, and $a+b+c+d\leqq 1$. Because of the specific composition, the carrier core particles are provided with a smooth surface, which is reflected into a surface smoothness of the resin-coated carrier even after coated with a thin resin coating layer. Accordingly, the resin-coated carrier is provided with a good balance among toner-charging ability, flowability and durability suitable for reproduction of an original having a large areal percentage.

61 Claims, 2 Drawing Sheets

RESIN-COATED CARRIER, TWO-COMPONENT DEVELOPER AND IMAGE FORMING METHOD

FIELD OF THE INVENTION AND RELATED ART

The present invention relates to a carrier in a developer used for developing electrical latent images or magnetic latent images in electrophotography, electrostatic printing, etc., and particularly a resin-coated carrier with improved durability, image forming characteristic and environmental characteristic, and a two-component developer and an image forming method using the resin-coated carrier.

Carriers forming two-component developers are roughly classified into an electroconductive carrier and an insulating carrier. As the electroconductive carrier, oxidized or monoxidized iron powder has been ordinarily used. In a two-component developer using such an iron powder carrier together with a toner, however, the triboelectric chargeability of the toner is liable to be unstable, and the resultant visible images formed by using the two-component developer are liable to be accompanied with fog. More specifically, as the two-component developer is continually used, toner particles are attached onto the carrier particle surfaces to increase the electrical resistivity of the carrier particles, whereby the bias current is lowered and the triboelectric charge becomes unstable, so that the developed visible images are liable to have a lower image density and be accompanied with increased fog. Accordingly, when a two-component developer containing such an iron powder carrier is used for continuous copying in an electrophotographic copying apparatus, the developer is liable to be deteriorated in a relatively small number of cycles, and the developer has to be exchanged in a short period, thus resulting in an increased running cost.

The insulating carrier representatively has a structure comprising a carrier core of a ferromagnetic material, such as iron, nickel or ferrite, and an insulating resin layer uniformly coating the carrier core. In a two-component developer using such an insulating carrier, the toner particles are less liable to be melt-attached onto the carrier surfaces than in the case of an electroconductive carrier, and it is easy to control the triboelectric chargeability between the toner and the carrier. Thus, the two-component developer is provided with an excellent durability and a longer life, so that it is particularly suitable in a high-speed electrophotographic copying machine.

Various properties are required of an insulating carrier, inclusive of appropriate charging performance, impact resistance, anti-wearing characteristic, good adhesion between the core and the coating material and uniform charge distribution, as particularly important properties.

In view of the above-mentioned requirements, conventionally used insulating carriers still have left room for improvement, and perfect ones are not available so far. For example, the use of an acrylic resin as a carrier coating material has been disclosed in Japanese Laid-Open Patent Application (JP-A) 47-13954 and JP-A 60-208765. Particularly, the molecular weight effect of the coating material is discussed in JP-A 60-208767, which teaches that the charging performance of a coated carrier is stabilized if the molecular weight of the coating resin is controlled at constant. On the other hand, the attachment of a coating resin onto a carrier core material is remarkably affected by coating apparatus conditions and environmental conditions, particularly humidity, and even under strict control of these conditions, it is difficult to stably attach the resin onto the core material to provide sufficient charging performance and durability, so that satisfactory performances cannot be attained.

Several proposals have been made for using a coating layer of a resin showing a low surface energy for preventing spent toner accumulation on the carrier due to toner melt-sticking, etc., and silicone resin has been raised as an example of the resin having a low surface energy.

Silicone resin has advantageous features of not only low surface energy (tension) but also high water-repellency, but on the other hand, has a drawback of providing a coating layer liable to be peeled due to poor adhesiveness.

For providing a solution to the problem, various proposals have been made, including use of a resin-modified silicone resin (JP-A 55-127569), inclusion of vinylsilane for reaction with another resin (JP-A 56-32149), use of a mixture of trialkoxysilane and ethylcellulose (U.S. Pat. No. 3,840,464), and use of a mixture of organosilicone terpolymer and polyphenylene resin (U.S. Pat. No. 3,849,127). These proposals are however accompanied with problems, such as the necessity of a high temperature of 300° C. or higher for forming the coating film, and poor mutual solubility between silicone resin and another resin to result in an ununiform coating film, thus failing to achieve desired performances. It has been also proposed to form a coating film at a relatively low curing temperature (JP-A 55-127569). However, the resultant coating film is liable to show an insufficient adhesion and insufficient toughness, thus being liable to be worn. As a result, if the carrier particles are subjected to collision with the inner wall of the developing device or the photosensitive member surface or collision with each other due to strong stirring for long hours within the developing device, e.g., in a high-speed coating apparatus, the silicone resin coating layer is worn or peeled apart with time, so that the triboelectrification changes from one between the toner and the silicone resin to one between the toner and the carrier core, whereby the triboelectric charge of the developer is not made constant to result in deterioration of image qualities.

In recent years, there are increasing demands for higher resolution and higher image qualities of copying machines on the market, and the use of a smaller particle size toner has been tried for accomplishing high-quality color images. However, a smaller particle size toner is caused to have an increased surface area per unit weight and thus tends to have a larger triboelectric chargeability, which is liable to result in a lower image density and inferior continuous image forming performances.

In color copying using a chromatic toner, a continuous gradation characteristic is an important factor affecting the image quality, and the occurrence of the edge effect that images with an emphasized contour are liable to be formed after continuous copying on a large number of sheets can remarkably impair the gradation of the resultant images. A false contour can be found in the neighborhood of an actual contour, and this impairs the reproducibilities of copying inclusive of color reproducibility in color copying. The areal image percentage in conventional mono-chromatic copying is 10% or below, wherein most images reproduced are line images, such as those of letters, documents and reports. In contrast thereto, a high percentage or area of reproduced images are occupied with solid images with gradation, such as photographs, technical brochures, map and pictures giving an image areal percentage of 20% or higher at the least.

When continuous copying is performed by using an original having such a high image areal percentage, high image density copied products may be produced at the initial stage, but the toner replenishment to the two-component developer is liable to be gradually insufficient to result in difficulties, such as a lowering in image density of the resultant images, the supply of the replenished toner in an insufficiently charged state to the developing region to cause fog, and a local fluctuation in toner concentration (i.e., toner carrier mixing ratio) on the developing sleeve, leading to scartchy or fading images and nonuniform image densities. This tendency is more pronounced in the case of smaller size toners.

These difficulties may be attributable to a lower toner content (i.e., concentration) in the developer, or a poor rise in triboelectric chargeability due to failure in quick triboelectrification between the replenished toner and the carrier in the two-component developer, whereby the toner having an insufficient and uncontrolled charge is involved in the developing to cause insufficient development and fog.

An ability of always outputting good quality images in continuous copying of an original having a large areal image percentage, is essential for a color developer. Heretofore, the compliance with an original having a large areal image percentage causing a very high rate of toner consumption has been performed principally by an improvement of the developing device rather than an improvement of the developer per se. More specifically, it has been practiced to use a larger circumferential speed of developing sleeve or a larger diameter of developing sleeve to increase the frequency of contact of the developing sleeve with electrostatic latent images.

Such a measure can increase the developing capacity but is accompanied with difficulties, such as soiling within the copying apparatus due to toner scattering from the developing device and restricted life of the apparatus due to an increased load on the developing device. In some cases, the insufficient developing capacity or performance of a developer is recovered by charging the developing device with a larger amount of developer, but this also incurs difficulties, such as an increased weight of the copying apparatus, a larger apparatus size leading to an increased cost and an excessive load on drive of the developing device, thus being not so desirable.

For achieving quicker rise in charging performance of a two-component developer, JP-A 8-6302 and JP-A 8-69185 have proposed to control the surface property of a carrier core material, thereby providing the carrier with improved flowability and improved toner-conveying performance, but the satisfactory achievement has not been attained.

JP-A 8-22150 has proposed to reduce the fluctuation in magnetization of carrier particles and provide an improved charging performance due to uniformization of carrier flowability by magnetic force, but the control of carrier core surface property is insufficient and the achievement of quick charging performance of a two-component developer has not been successful only by the magnetic function.

In a two-component developer, it is necessary to control the ratio between the toner and the carrier within a constant range. The control contributes partially to stabilization of developing performance. As a method of achieving this, there is an optical toner concentration detection method wherein a ratio of the toner and the carrier (i.e., a toner concentration) within a developing device is detected in terms of a reflection light quantity from the developer through a detection window or unit, but the detection window can be soiled with the toner depending on a toner charged state or carrier flowability to remarkably change the detected toner concentration, thus resulting in a remarkable change in density of the resultant images. The problem of malfunction due to soiling of the window during optical detection has not been fully solved in the case of continually outputting images having a large areal image percentage or in the case of continually outputting images having a small areal image percentage particularly in a low-humidity environment.

More specifically, in the case of continually outputting images of a large areal image percentage, the soiling of the detection unit liable to be caused in a high-humidity environment is attributable to inferior flowability of the developer, particularly the carrier therein, so that the toner fails to be sufficiently blended with the carrier and charged, thus being attached to the detection window. On the other hand, the soiling of the window in a low humidity environment liable to be caused in the case of continually outputting images of a small areal image percentage is principally attributable to a poor smoothness of coating resin and a lower frequency of exchange in the case of images of a small areal percentage, so that the toner is liable to be excessively charged and the excessively charged toner causes a portion of toner charged to an opposite polarity, which is liable to be attached to the detection window.

SUMMARY OF THE INVENTION

A generic object of the present invention is to provide a resin-coated carrier having solved the above-mentioned problems of the prior art.

A more specific object of the present invention is to provide a resin-coated carrier capable of obviating the lowering in image density or scratchy or fading image even in continuous copying of a color original having a large areal image percentage.

A further object of the present invention is to provide a resin-coated carrier capable of providing clear images free from fog and exhibiting excellent continuous image forming performances.

Another object of the present invention is to provide a resin-coated carrier capable of providing image densities which are little dependent on environmental conditions.

A further object of the present invention is to provide a resin-coated carrier less liable to cause soling of an optical toner concentration detection part or window even in continuous copying of a color original having a large areal image percentage in various environments.

A still further object of the present invention is to provide a two-component developer and an image forming method using the above-mentioned resin-coated carrier.

According to the present invention, there is provided a resin-coated carrier, comprising: carrier core particles and 0.01–2.0 wt. % based on the carrier core particles of a resin coating layer coating the carrier core particles, wherein the carrier core particles comprise a ferrite component represented by formula (I) below:

$$(Fe_2O_3)_a(MnO)_b(MgO)_c(A)_d \quad (I),$$

wherein A represents a mixture of SrO, CaO and $Al_2O_3$, and a, b, c and d are numbers representing mol fractions of associated components and satisfying: $0.4<a<0.6$, $0.35<b<0.45$, $0.07<c<0.12$, $0.005<d<0.015$, and $a+b+c+d\leqq 1$, and the resin-coated carrier has an average particle size of 25–55 $\mu$m.

The present invention further provides a two-component developer comprising a toner and the above-mentioned resin-coated carrier.

The present invention further provides an image forming method, comprising:

a latent image forming step of forming an electrostatic latent image on an image-bearing member, and a developing step of forming a layer of a two-component developer comprising a toner and the above-mentioned resin-coated carrier on a developer-carrying member, carrying and conveying the two-component developer together with the developer-carrying member to a developing region where the developer-carrying member is opposite to the image-bearing member, and developing the latent image on the image-bearing member with the toner in the two-component developer carried on the developer-carrying member in the developing region.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
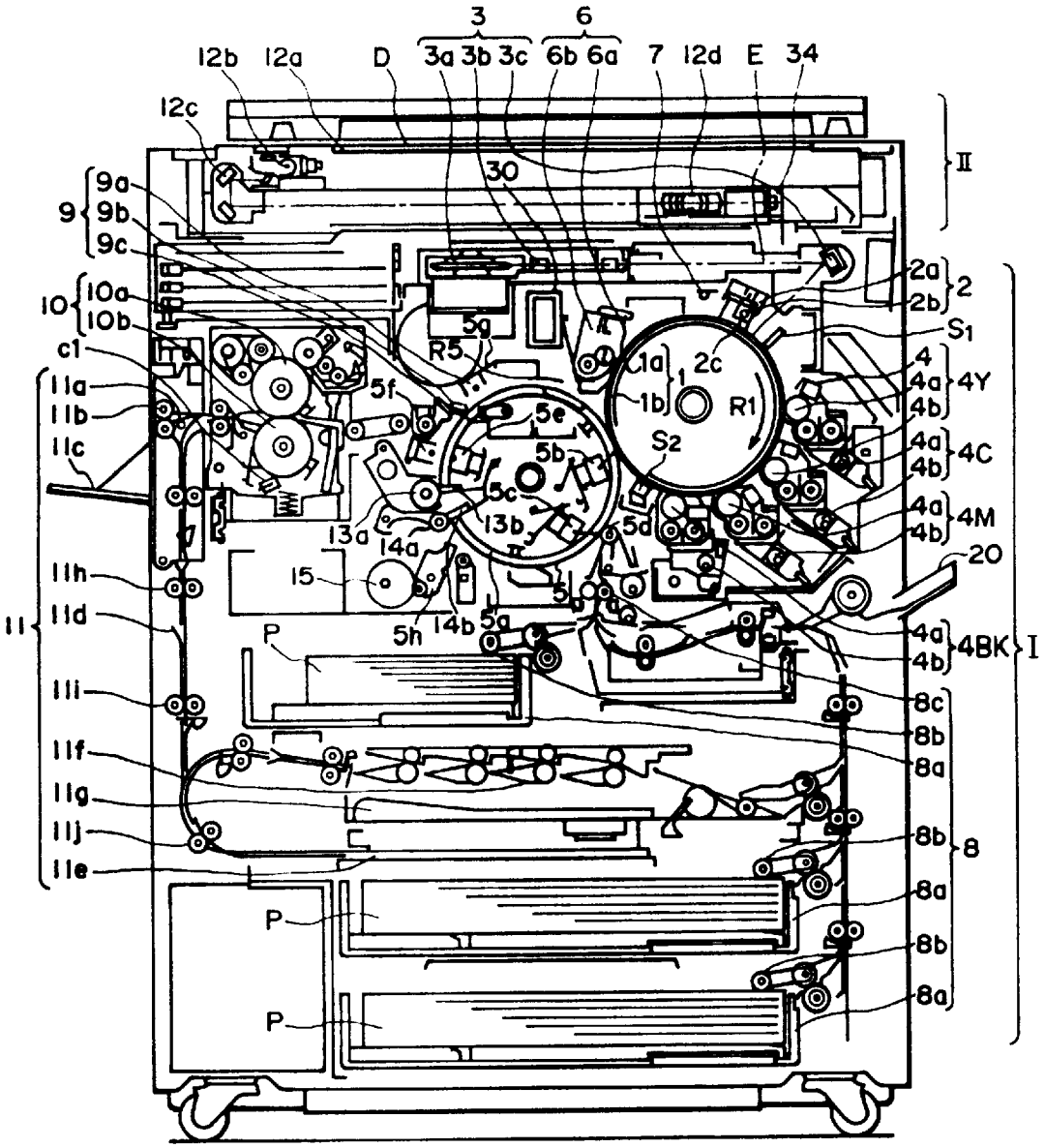
FIG. 1 illustrates an example of image forming apparatus suitable for practicing an embodiment of the image forming method according to the invention.

As a result of our study on the above-mentioned problems of the prior art, it has been found that if the carrier core of a resin-coated carrier is formed of a ferrite component having a specific composition, it is possible to control the resistivity and magnetic properties at appropriate levels and form the carrier core particles in a smooth surface state with little unevennesses or wrinkles, whereby, if the carrier core particles are coated with a specific proportion of resin coating layer, the unique surface characteristic of the carrier core particles can be developed even to the surface of the resin coating layer. As a result, (i) the resin coating layer is provided with a surface smoothness that cannot be achieved heretofore, thereby exhibiting a uniform triboelectric charge-imparting performance to the toner, less liability of being soiled with melt-sticking toner, and thus improved continuous image forming performances of the carrier; and (ii) the resin coating layer is formed in a uniform thickness free from local irregularity, thus exhibiting a uniform triboelectric charge-imparting performance and being resistant to a mechanical impact thereto. As a synergistic effect of (i) and (ii), the resin-coated carrier exhibits an improved durability and a uniform triboelectric chargeability-imparting performance, thus leading to excellent continuous image forming performances. Moreover, (iii) as the resin-coated carrier is provided with appropriate levels of resistivity and magnetic properties and formed in a small average particle size, the resin-coated carrier can form a uniform magnetic brush on the developer-carrying member capable of quickly raising triboelectric chargeability to the toner, even in a high temperature/high-humidity environment.

The carrier core particles of the resin-coated carrier according to the present invention comprise a ferrite component represented by formula (I) below:

$$(Fe_2O_3)_a(MnO)_b(MgO)_c(A)_d \quad (I),$$

wherein A represents a mixture of SrO, CaO and $Al_2O_3$, and a, b, c and d are numbers representing mol fractions of associated components and satisfying: $0.4<a<0.6$, $0.35<b<0.45$, $0.07<c<0.12$, $0.005<d<0.015$, and $a+b+c+d\leqq 1$, preferably represented by formula (II) below:

$$(Fe_2O_3)_a(MnO)_b(MgO)_c(A)_d(SiO_2)_e \quad (II),$$

wherein A represents a mixture of SrO, CaO and $Al_2O_3$, and a, b, c, d and e are numbers representing mol fractions of associated components and satisfying: $0.4<a<0.6$, $0.35<b<0.45$, $0.07<c<0.12$, $0.005<d<0.015$, $0.0005<e<0.002$ and $a+b+c+d+e\leqq 1$.

In the above formulae (I) and (II), if $a\leqq 0.04$, the carrier core particles are caused to have a high resistivity, so that the resultant images are affected by a strong edge effect of the developing electric field and the effective developing electric field strength is lowered to result in a lower image density. If $a\geqq 0.6$, the carrier core particles are caused to have a lower resistivity and exert a lower magnetic force, thus resulting in lower ears of carrier leading to a lower image density.

If $b\leqq 0.35$, the carrier core particles are caused to have a low resistivity to result in traces of electric field leakage from the carrier. If $b\geqq 0.45$, the magnetic property of the carrier is lowered to result in carrier attachment.

If $c\leqq 0.07$, the carrier core particles are caused to have a lower resistivity to result in traces of electric field leakage from the carrier, and if $c\geqq 0.12$, the carrier core particles are caused to have a higher resistivity to result in strong edge effect.

If $d\leqq 0.05$, the carrier core particles are liable to have a wrinkled surface, and if $d\geqq 0.015$, the carrier core particles are liable to be agglomerated during calcination, so that the carrier core particles are liable to fail in providing smooth surfaces even after disintegration.

The ferrite component represented by the formula (II) is characterized by further including $SiO_2$ in the ferrite component of the formula (I) for providing a smooth surface of resin-coated carrier especially when coated with a silicone resin. In this case, if $e \leqq 0.0005$, the effect of $SiO_2$ addition is scarce, and if $e \geqq 0.002$, the carrier core particles are liable to have a high resistivity.

The mixture represented by A in the formulae (I) and (II) may preferably contain SrO, CaO and $Al_2O_3$ in amounts satisfying the following relationship: $SrO \geqq CaO \geqq Al_2O_3 \geqq 0.05$ mol. % (based on ferrite). In case of $SrO<CaO$ or $CaO<Al_2O_3$, the carrier core particles during the production are liable to coalesce with each other, thereby failing to stably provide the image surface smoothness of the carrier core particles.

The numbers a to e represent amounts in terms of mol. % calculated as metal oxides. In order to determine the compositonal ratio for a resin-coated carrier, a sample carrier is subjected to decomposition at 600° C. or higher for removal of the resin, and the residue is dissolved in a solution of hydrochloric acid and hydroxylammonium chloride and subjected to ICP-AES (inductively coupled plasma-atomic emission spectrometry) to measure atomic % values of respective metal elements, which are then converted into mol. % value of the corresponding metal oxides.

The resin-coated carrier of the present invention may have an average particle size of 25–55 μm, preferably 30–55 μm, more preferably 30–50 μm, further preferably 35–45 μm. If the average particle size is below 25 μm, the carrier is liable to provide ununiform ears of the developer under magnetic field on the developer-carrying member, thus failing to provide uniform solid images. If the average particle size exceeds 55 μm, excessively high ears of the developer are liable to be formed under magnetic field, thus being liable to leave sweeping traces of the ears. It is preferred that particles of 21 μm or small are at most 6.0% by volume, more preferably at most 4.0% by volume. Above 6.0% by volume, the carrier is liable to have inferior flowability, thus resulting in inferior uniformity of images.

It is also preferred that particles of 72 μm or larger are at most 6.0% by volume, more preferably at most 4.0% by volume. Above 6.0% by volume, ears of the developer are liable to be disordered to result in inferior clarity of images.

The carrier core particles having the above-mentioned specific composition have a unique surface characteristic such that a level of smoothness that cannot be realized heretofore even after resin coating thereon. The smoothness may be represented by a relationship of $$0.5 \leqq S1/(\rho/D) \leqq 1.2$$

among a BET specific surface area S1 ($cm^2/g$), an average particle size D (cm) and a true specific gravity $\rho$($g/cm^3$), respectively, of the resin-coated carrier, thus providing a carrier with a good flowability and a two-component developer capable of exhibiting a high image density and good highlight reproducibility and thin-line reproducibility.

If the parameter S1/(ρ/D) is below 0.5, the resin coating on the carrier is liable to be thin and be peeled during the continual use of the coated carrier. On the other hand, if S1/(ρ/D) exceeds 1.2, the resin coating layer is liable to be microscopically formed in an undulated state or a porous state, thus lowering the flowability of the carrier and failing to exhibit sufficiency of high image density, highlight reproducibility and thin-line reproducibility.

An appropriate resin coating rate may be represented by a relationship of:

$$D/500 \leqq W \leqq D/300,$$

preferably, $$D/450 \leqq W \leqq D/350,$$

between the average particle size D (μm) and resin coating weight per weight of the carrier core W (wt. %), so as to provide the carrier with a good surface property, good toner-charging performance and good continuous image forming performance.

The carrier coating resin used in the present invention may suitably comprise, e.g., silicone resin, acryl-modified silicone resin, epoxy resin, polyester resin, styrene-acrylic resin, melamine resin, fluorite-containing resin, fluorine-containing acrylic resin and mixtures of these. It is particularly preferred to use silicone resin or acryl-modified silicone resin.

Examples of the acryl-modified silicone resin may include: methacrylate-modified silicone resin, acrylate-modified silicone resin, styrene/methacrylate-modified silicone resin, and styrene/acrylate-modified silicone resin.

The above silicone resin and modified silicone resins may be used singly or in mixture of two or more species.

More specifically, silicone oligomers or silicone resins having structural units of the following formulae (I) and (II) suitable as coating particles:

(I)

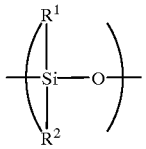

(II)

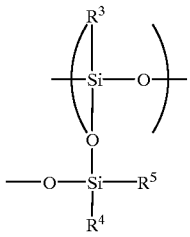

(wherein $R^1$–$R^5$ independently denote a hydrocarbon group selected from methyl, ethyl and phenyl) may be formed from, e.g.,

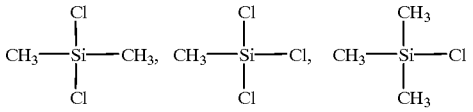

or

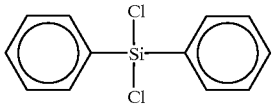

as a starting material. At the time of forming such silicone oligomers or silicone resins, it is also possible to use one or more of compounds of the following formulae (III), (IV), (Va) and (Vb):

(III)

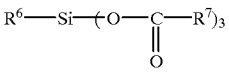

wherein $R^6$ and $R^7$ independently denote a hydrocarbon group having at least one carbon atoms;

(IV)

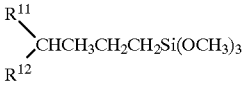

wherein $R^{11}$ and $R^{12}$ independently denote H, $CH_3$—, $CH_3CH_2$— or

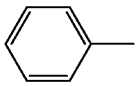

(Va)

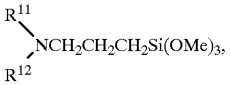

(Vb)

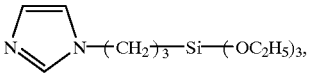

wherein $R^{11}$ and $R^{12}$ independently denote H, $CH_3$—, $CH_3CH_2$— or

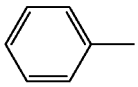

It is also possible to use a (meth)acrylate-modified silicone oligomer or resin formed by reacting a methacrylate ester or an acrylate ester with a compound of the following formula (VI):

(VI)

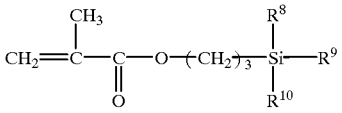

wherein $R^8$, $R^9$ and $R^{10}$ independently denote —$CH_3$, —$CH_2CH_3$, —$OCH_3$ or —$OCH_2CH_3$ with the proviso that at least one of $R^8$, $R^9$ and $R^{10}$ is —$OCH_3$ or —$OCH_2CH_3$, by itself or in combination with the above-mentioned silicone oligomer or resin.

It is possible to further add a silane coupling agent or a titanate coupling agent, as desired.

The resin coating may ordinarily be performed by coating the carrier core particles with a dilution with a solvent of the coating resin. The solvent may appropriately be selected depending on the coating resin and the type of the coating liquid. For example, for an organic solvent-soluble resin, organic solvents, such as toluene, xylene, cellosolve butyl acetate, methyl ethyl ketone, methyl isobutyl ketone and methanol, may be used. Water may also be used for a water-soluble resin or providing an emulsion-type coating liquid. The surface coating of the carrier core particles with a resin coating liquid may be performed, e.g., by dipping, spraying, brush coating or mixture-kneading, followed by vaporization of the solvent. Instead of such a wet coating method using the solvent, it is also possible to surface-coat the carrier core particles with resin powder by a dry coating method.

The resin coating on the carrier core particles may be further subjected to baking as desired according to any of the external heating method or the internal heating method, e.g., by using a fixed-type or flow-type electric furnace, a rotary electric furnace, a burner furnace, or irradiation with microwave. The baking temperature may vary depending on the coating resin used but is generally required to exceed the melting point or the glass transition point of the coating resin. For a thermosetting resin or a condensation-type resin, a temperature causing a sufficient degree of curing or hardening is required.

After the resin coating and baking on the carrier core, the coated carrier is cooled, disintegrated and subjected to particle size adjustment to provide a resin-coated carrier.

The resin-coated carrier of the present invention may be blended with a toner to provide a two-component developer. The toner used for this purpose may preferably have a weight-average particle size (D4) of 4.0–10.5 $\mu$m, more preferably 4.5–9.0 $\mu$m.

A toner having a weight-average particle size of below 4.0 $\mu$m is liable to have an excessively large triboelectric charge in a low humidity environment, thus exhibiting a lower developing performance. A toner having a weight-average particle size exceeding 10.5 $\mu$m is liable to exhibit inferior thin-line reproducibility and smoothness of halftone images.

It is preferred for a toner used in the present invention to have a particle size distribution such that toner particles of 4 $\mu$m or smaller occupy 5–40% by number, preferably 10–30% by number, of all the particles. Below 5% by number, small toner particles effective for high-quality image formation are liable to be insufficient, and particularly such effective small toner particles are preferentially used on continuation of copying or printing out, thus resulting in an imbalance of toner particle size distribution to gradually lower the image quality. This tendency is particularly pronounced when used in combination with the carrier of the present invention. If the amount of the toner particles of 4 μm or smaller exceeds 40% by number, the toner particles are liable to agglomerate with each other to form a toner block exceeding the original particle size, thus resulting in rough image quality, lower resolution, and images liable to be accompanied with hollow image dropout characterized by a large density difference between an edge or contour and a middle part of a latent image.

It is preferred that the content of toner particles of 8 μm or larger is 2.0–20.0% by volume, preferably 3.0–18.0% by volume. If the content of toner particles of 8 μm or larger exceeds 20.0% by volume, the resultant image quality is lowered, and also excessive development, i.e., excessive toner coverage, is liable to occur, thus incurring an increased toner consumption. If the content of toner particles of 8 μm or larger is below 2.0% by volume, the resultant toner is liable to result in inferior image quality due to a lowering in flowability, in spite of any improvement in toner prescription.

The toner used in the present invention may be produced through a process wherein ingredients thereof are well melt-kneaded by a hot kneading means, such as hot rollers, a kneader or an extruder, followed by mechanical pulverization and classification, a process wherein materials, such as a colorant, are dispersed in a binder resin solution, and the resultant dispersion liquid is dried by spraying, or a polymerization toner production process wherein prescribed materials, such as a colorant, are blended with a monomer (mixture) providing the binder resin to form a polymerizable liquid, which is then emulsified or suspended within a dispersion medium to be polymerized into toner particles.

The binder resin constituting the toner may comprise various resins used conventionally as binder resins for electrophotographic toners. Examples thereof may include; polystyrene; styrene copolymers, such as styrene-butadiene copolymer and styrene-acrylate copolymers; polyethylene; ethylene copolymers, such as ethylene-vinyl acetate copolymer, and ethylene-vinyl alcohol copolymer; phenolic resin, epoxy resin, allyl phthalate resin, polyamide resin, polyester resin, and maleic acid resin. These resins produced through any processes can be used.

The effect of the present invention can be particularly noticeably exhibited especially when polyester resin having a high negative chargeability is used among these resins. More specifically, polyester resin is excellent in fixability and is suitably used for providing a color toner but is liable to be excessively charged because of strong negative chargeability. However, the difficulty accompanying the use of polyester resin can be alleviated if the resultant toner is combined with the resin-coated carrier of the present invention, so that an excellent negatively chargeable toner is provided.

Particularly, a preferred class of polyester resins having a sharp melting characteristic may be provided by using, as a diol component, a bisphenol derivative of the following formula:

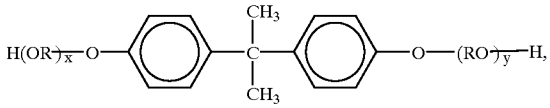

wherein R denotes an ethylene or propylene group, x and y are independently an integer of 1 or more with the proviso that the average of x+y is in the range of 2–10, or a substitution derivative thereof, and a carboxylic acid component selected from carboxylic acids having at least two carboxylic groups such as fumaric acid, maleic acid, anhydrides thereof and lower alkyl esters thereof, such as fumaric acid, maleic acid, maleic anhydride, phthalic acid, terephthalic acid, trimellitic acid and pyromellitic acid, for copolycondensation.

The toner used in the present invention can contain a charge control agent so as to have a stable chargeability. For a color toner, it is preferred to use a colorless or only pale-colored charge control agent not affecting the hue of the resultant toner. Examples of negative charge control agent suitable for such color toners may include: organo-metal complexes, inclusive of metal complexes of alkyl-substituted salicylic acid, such as aluminum complex or zinc complex of di-tert-butylsalicylic acid. Such a negative charge control agent, when used, may preferably be incorporated in a proportion of 0.1–10 wt. parts, more preferably 0.5–8 wt. parts, per 100 wt. parts of the binder resin. If the amount of the negative charge control agent is below 0.1 wt. part, the addition effect thereof is scarce, and above 10 wt. parts, the relaxation of charge becomes noticeable in a high humidity environment, so that the charge is liable to be decreased to result in toner scattering.

Some additives can be added, as desired, to the toner used in the present invention within an extent of not adversely affecting the toner properties. Examples of such additives may include: lubricants, such as polytetrafluoroethylene, zinc stearate and polyvinylidene fluoride; fixing aids, such as low-molecular weight polyethylene and low-molecular weight polypropylene; and organic resin particles.

The toner used in the present invention may contain a colorant, which may be a known dye or pigment, examples of which may include: Phthalocyanine Blue, Indanthrene Blue, Peacock Blue, Permanent Red, Lake Red, Rhodamine Lake, Hansa Yellow, Permanent Yellow, and Benzidine Yellow. The content thereof should be suppressed to at most 12 wt. parts so as to sharply affect the transmittance through an OHP film, preferably 0.5–9 wt. parts per 100 wt. parts of the binder resin. If the content exceeds 12 wt. parts, the amount of the colorant liberated from the toner particles is liable to be increased to soil the carrier and/or the developer-carrying member surface.

In case where a two-component developer is prepared by blending the toner and the carrier of the present invention, the blending ratio should be such that the toner concentration in the developer is 2–12 wt. %, preferably 3–9 wt. %, so as to provide good results. If the toner concentration is below 2 wt. %, the resultant image density can be lowered to a practically unacceptable level, and above 12 wt. %, the toner fog and scattering within the apparatus is liable to be increased, so that the developer life can be shortened.

In the present invention, it is preferred to constitute a developer from a toner having a weight average particle size (D4) of 1–9 μm containing inorganic fine particles having a number-average particle size (D1) of 0.001–0.2 μm. Surface-treated titanium oxide or alumina particles are particularly preferred as such inorganic fine particles. More specifically, such alumina or titanium oxide fine particles per se have an almost neutral chargeability, and the toner prepared by external addition thereof is generally caused to have a slowly rising chargeability. Even such a toner externally added with titanium oxide or alumina particles can acquire a very good charge-rising characteristic when combined with the carrier of the present invention, and does not cause image quality deterioration such as fog or image density lowering even when an original having a large image area percentage, such as a full-color original, is continuously copied or printed out.

A preferred class of titanium oxide or alumina fine particles suitably used in the present invention because of stable chargeability and flowability of the resultant toner may be obtained by surface-treating fine particles of anatase-form titanium oxide, amorphous titanium oxide or alumina with a coupling agent while causing hydrolysis of the coupling agent in the presence of water.

Such inorganic fine particles may be added in 0.5–5 wt. %, preferably 0.7–3 wt. %, more preferably 1.0–2.5 wt. %, based on the toner particles externally blended therewith. If the amount is less than 0.5 wt. %, the toner flowability improvement is liable to be insufficient, and in excess of 5 wt. %, a portion of the inorganic fine powder isolated from the toner particles is liable to cause filming on the photosensitive member.

In a preferred embodiment of the image forming method according to the present invention, a two-component developer prepared in the above-described manner is used for development of a latent image under application of a DC/AC-superposed electric field between a latent image-bearing member and a developer-carrying member.

More specifically, while a developing method using a two-component developer under application of a DC/AC-superposed bias voltage is known heretofore, the carrier conventionally used has been a high-resistivity carrier obtained by coating low-resistivity carrier core particles with a large amount of resin so as to obviate disorder of latent images due to leakage of the bias voltage or charge injection of the latent image charge to the carrier under application of a very large peak electric field exerted by the DC/AC-superposed bias voltage. However, the coating with such a large amount of resin has caused a lowering in carrier flowability, thereby rather impairing the long-term performance stability.

On the other hand, the resin-coated carrier of the present invention is formed as a high-resistivity carrier showing good flowability by coating high-resistivity carrier core particles with a thin layer of resin having a low surface energy, whereby high-quality images free from image quality deterioration due to bias voltage leakage, carrier attachment and charge injection can be formed for a long period.

Some parameters described herein for characterizing the resin-coated carrier and two-component developer of the present invention are based on values measured according to the following methods.

1. Carrier Particle Size (Distribution)

Measured by using a laser diffraction-type particle size distribution meter ("HELOS", available from Nippon Denshi K.K.) equipped with a dry dispersion unit ("RODOS", available from Nippon Denshi K.K.) under conditions of: a lens focal distance of 200 mm, a dispersion pressure of 3.0 bar and a measurement time of 1–2 sec. for a particle size range of 0.5 μm to 350 μm divided into 31 channels of each respective particle size ranges are shown in Table A below. From the obtained volume-basis distribution, a medium particle size giving an accumulative 50% by volume was determined as an average particle size, and percentages by volume of respective particle size ranges were determined based on the volume-basis frequency distribution.

TABLE A

| Range (μm) | Range (μm) | Range (μm) | Range(μm) |
|---|---|---|---|
| 0.5–1.8 | 6.2–7.4 | 25.0–30.0 | 102.0–122.0 |
| 1.8–2.2 | 7.4–8.6 | 30.0–36.0 | 122.0–146.0 |
| 2.2–2.6 | 8.6–10.0 | 36.0–42.0 | 146.0–174.0 |
| 2.6–3.0 | 10.0–12.0 | 42.0–50.0 | 174.0–206.0 |
| 3.0–3.6 | 12.0–15.0 | 50.0–60.0 | 206.0–246.0 |
| 3.6–4.4 | 15.0–18.0 | 60.0–72.0 | 246.0–294.0 |
| 4.4–5.2 | 18.0–21.0 | 72.0–86.0 | 294.0–350.0 |
| 5.2–6.2 | 21.0–25.0 | 86.0–102.0 | |

*Each range includes the lower limit and not the upper limit.

The laser diffraction-type particle size distribution meter ("HELOS") used in the above measurement is based on the principle of Fraunhofer's diffraction, wherein sample particles are irradiated with a laser beam from a laser source to form diffraction images on a focal plane of a lens disposed on an opposite side with respect to the laser source, and the diffraction images are detected by a detector and processed to calculate a particle size distribution of the sample particles.

2. BET Specific Surface Areas S1 of Carriers

Measured by using a BET specific surface area meter ("Micromellitic Gemini 2375", available from Shimazu Seisakusho K.K.).

3. True Specific Gravity ρ

Measured by using a dry type automatic density meter ("Acupic 1330", available from Shimazu Seisakusho K.K.).

4. Toner Particle Size Distribution

Measurement apparatus used was Coulter counter Model TA-II (available from Coulter Electronics Inc.), to which an interface for outputting a number-basis distribution and a volume-basis distribution (available from Nikkaki K.K.) and a personal computer ("CX-1", available from Canon K.K.) were attached. An electrolytic solution was prepared as a 1%-NaCl aqueous solution by using a reagent-grade sodium chloride.

For measurement, 0.1–5 ml of a surfactant, preferably an alkylbenzenesulfonate salt, is added as a dispersant to 150 ml of the above electrolytic solution, and 0.5–50 mg of a sample is added thereto.

The electrolytic solution containing the sample is subjected to ca. 1 to 3 min. of dispersion treatment by an ultrasonic disperser and subjected to measurement of a volume-basis distribution and a number-basis distribution by the Counter counter equipped with a 100 μm-aperture for particles in the range of 2.00 to 50.80 μm. From the distribution, a weight-average particle size (D4) is calculated.

5. Average Particle Size of Inorganic Fine Particles

Sample particles are observed and photographed through a transmission electron microscope (TEM) at a magnification of $10^5$ so as to provide enlarged pictures on which at least 300 particles having longer axis diameters of 1–10 mm can be confirmed, and 300 particles having longer axis diameters of at least 0.5 mm are selected at random for measurement of the longer axis diameters. From the measured particle size data, a number-average particle size (D1) of the sample inorganic fine particles is determined.

In case where at least 300 particles having longer-axis diameter cannot be confirmed on pictures at a magnification of $10^5$, the pictures are enlarged by an electrophotographic copier to provide further enlarged pictures on which at least 300 particles having a longer-axis diameter of 1–10 mm can be confirmed.

Next, an image forming method using the above-mentioned two-component developer will be described.

The image forming method includes a developing step using a developing device including a developing sleeve (developer-carrying member) and a magnet roller installed therein, of which the magnetic roller is fixed and only the developing sleeve is rotated to carry thereon a two-component developer comprising magnetic carrier particles and an insulating color toner for conveyance to a developing region where an electrostatic latent image on an (electrostatic latent) image-bearing member is developed with the toner in the two-component developer to form a toner image on the image bearing member.

A preferred example of image forming apparatus for practicing such an embodiment of the image forming method according to the present invention will be described with reference to FIG. 1.

An image forming apparatus shown in FIG. 1 includes a digital color image printer unit (hereinbelow called "printer unit") I disposed in a lower part thereof and a digital color image reader unit (hereinafter called "reader unit") II disposed above the printer unit I, so that, e.g., an image is formed on a recording material P by the printer unit I based on an image of original D read by the reader unit II.

Now, first the organization of the printer unit I and then the organization of the reader unit II will be described.

The printer unit I includes a photosensitive drum 1 driven in rotation in the direction of an arrow R1 as an electrostatic latent image bearing member. Around the circumference of the photosensitive drum 1 are disposed in order along the rotation direction thereof a primary charger (charging means) 2, an exposure means 3, a developing apparatus (developing means) 4, a transfer device 5, a cleaning device 6, and a pre-exposure lamp 7. Below the transfer device 5, i.e., as a lower half of the printer unit I, a supply and conveying unit 8 for recording materials P is disposed. Above the transfer device 5, a separation means 9 is disposed, and downstream (with respect to the recording material P conveyance direction) of the separation means 9, a heat-pressure fixing device 10 and a paper discharge unit 11 are disposed.

The photosensitive drum 1 includes an aluminum-made drum substrate 1*a* and a layer of photosensitive member 1*b* of OPC (organic photoconductor) surface-coating the drum substrate 1*a* and driven in rotation at a prescribed process speed (peripheral speed) in the arrow R1 direction by a drive means (not shown). The primary charger 2 is a corona charger including a shield 2*a* having an opening toward the photosensitive drum 1, a discharge wire 2*b* disposed within the shield 2*a* and in parallel with a generatrix of the photosensitive drum 1 and a grid 2*c* disposed at the opening of the shield 2*a* for regulating the charging potential. The primary charger 2 is supplied with a charging bias voltage from a voltage supply (not shown), thereby uniformly charging the photosensitive drum 1 surface to a prescribed potential of a prescribed polarity.

The exposure means 3 includes a laser beam-emitting unit (not shown), a polygonal mirror 3*a* for reflecting the laser beam, a lens 3*b* and a mirror 3*c*. The exposure means 3 is organized so as to expose the photosensitive drum 1 by irradiating the photosensitive drum 1 surface with the laser beam, thereby removing the charge at the exposed part to form an electrostatic latent image on the photosensitive drum 1. In this embodiment, an original image is color separated into four colors of yellow, cyan, magenta and black, and electrostatic images corresponding to the respective colors are sequentially formed on the photosensitive drum 1 surface.

The developing apparatus 4 includes developing devices 4Y, 4C, 4M and 4B*k* containing respective color toners of yellow toner, cyan toner, magenta toner and black toner and disposed in this order from an upstream position along the rotation direction (direction of arrow R1) of the photosensitive drum 1. Each of the developing devices 4Y, 4C, 4M and 4B*k* includes a developing sleeve 4*a* for carrying a two-component developer containing a color toner for developing an electrostatic latent image formed on the photosensitive drum 1, and one developing device of a prescribed color used for developing the electrostatic image currently formed on the photosensitive drum is selectively brought to a developing position in proximity to the photosensitive drum 1 surface by the function of an eccentric cam 3*b*. As a result, the toner in the developer held on the developing device 4*a* of the selected one color is used to develop the electrostatic latent image on the photosensitive drum 1, and the developing devices of the other three colors are disposed at positions retreating from the developing position.

The organization of a developing device 4 (each of 4Y, 4C, 4M and 4B*k* in FIG. 1) is described in further detail with reference to FIG. 2. The developing device 4 includes a developer vessel 46, which is divided into a developing chamber (first chamber) R1 and a stirring chamber (second chamber) R2 by a partitioning wall 47. Above the stirring chamber R2, a toner storage chamber R3 is defined. In the developing chamber R1 and the stirring chamber R2, a two-component developer 49 comprising a non-magnetic toner and a magnetic carrier is contained. A replenishing toner (non-magnetic toner) 48 is stored in the toner storage chamber R3 and is supplied therefrom at a rate corresponding to the consumed amount of the toner from the developing chamber R1 by dropping through a replenishing port 40 disposed at the bottom of the chamber R3 into the stirring chamber R2. The replenishment of the toner 48 into the stirring chamber R2 is performed when the toner concentration of the two-component developer 49 in the developing chamber R1 is lowered to a prescribed level as detected by an optical toner concentration detection member 50, which is disposed at a position contacting the developer 49 in the developing chamber R1 and has a contacting surface provided with a detection window composed of a transparent material so as to illuminate the developer 49 and measure a reflected light quantity from the developer 49.

In the developing chamber R1, a conveying screw 43 is disposed so as to convey the developer 49 in a longitudinal direction of a developing sleeve 41 by a rotation thereof. In the stirring chamber R2, a conveying screw 44 is similarly disposed so as to convey the replenishing toner 48 supplied to the stirring chamber R2 by dropping through the replenishing port 40 in the longitudinal direction of the developing sleeve 41 by a rotation thereof.

The developer vessel 46 is provided with an opening at a part close to a photosensitive drum 1, and a portion of the developing sleeve 41 protrudes out of the opening toward the outside so as to leave a gap between the developing sleeve 41 and the photosensitive drum 1. The developing sleeve 41 is composed of a non-magnetic material and is connected to a developing bias application means 53, so as to be supplied therefrom with a developing bias voltage at the time of development of an electrostatic image on the photosensitive drum 1 with the developer 49.

A magnet roller 42 as a magnetic field application means is fixedly housed within the developing sleeve 41 and includes a developing pole $S_2$, a pole $N_2$ disposed downstream of $S_2$, and poles $N_3$, $S_1$ and $N_1$ for conveying the developer 49. The developing pole $S_2$ of the magnet 42 is disposed at a position opposite to the photosensitive drum 1. The developing pole $S_2$ forms a magnetic field in the neighborhood of a developing region between the developing sleeve 41 and the photosensitive drum 1, and a magnetic brush of the two-component developer 49 is formed by the magnetic field.

A regulating blade 45 is disposed above the developing sleeve 41 so as to regulate the layer thickness of the developer 49 on the developing sleeve 41. The regulating blade 45, when composed of a magnetic material, is disposed to have a lowermost end with a gap from the sleeve 41 surface of 30–1000 $\mu$m, preferably 400–900 $\mu$m. If the gap is less than 300 $\mu$m, the magnetic carrier is liable to plug the gap, thus causing a coating irregularity of the developer layer, and also fail in forming a developer layer required for good development, thus resulting in developed images with a low density and much irregularity. In order to prevent an irregular coating due to unnecessary particles possibly contained in the developer (so-called "blade plugging"), a gap of 400 $\mu$m or larger is preferred. If the gap exceeds 1000 $\mu$m, an excessively large amount of developer is applied on the developing sleeve 41, thus failing to effect a desired developer layer thickness regulation, the attachment of the magnetic carrier onto the photosensitive drum 1 is increased, and the triboelectric charge of the toner is liable to be insufficient and result in fog due to weaker developer regulation by the magnetic blade 45.

The angle $\theta_1$ may be −5 deg. to +35 deg., preferably 0–25 deg. In case where $\theta_1$<−5 deg., the developer layer formed under the action of a magnetic force, an image force and an agglomeration force acting on the developer is liable to be sparse and accompanied with much irregularity, and in case where $\theta_1$>35 deg., an increased amount of developer is applied by a non-magnetic blade, so that it is difficult to obtain a prescribed developer amount.

A layer of magnetic carrier formed on the developing sleeve 41 moves along with the rotation of the developing sleeve 41, but the movement speed becomes slower as the distance from the sleeve 41 surface is increased by a balance between a constraint force based on magnetic force and gravity and a driving force due to the rotation of the sleeve 41. Some portion of the carrier can drop off the sleeve due to the gravity.

Accordingly, by appropriately selecting the positions of the poles $N_1$ and $N_2$ and the magnetic property and flowability of the magnetic carrier particles, the magnetic carrier layer moves toward the pole $N_1$ at a faster speed as it approaches the sleeve surface to form a moving layer. By the movement of the magnetic carrier along with the rotation of the developing sleeve 41, the developer 49 is conveyed to the developing region to be used for development. The toner scattering is suppressed by an upstream-side regulating member 51 and a downstream-side regulating member 52.

Referring again to FIG. 1, the transfer device 5 includes a transfer drum 5*a* carrying a transfer or recording material P on its surface, a transfer charger 5*b* for transferring a toner image on the photosensitive drum 1 onto the recording material P, an adsorption charger 5*c* for adsorbing the recording material P onto the transfer drum 5*a* and an adsorbing roller 5*d* disposed opposite thereto, an inside charger 5*e* and an outside charger 5*f*. The transfer drum 5*a* is supported on a shaft so as to be rotated in an arrow R5 direction, and an opening formed around a circumference thereof is covered integrally with a cylindrical recording material-carrying sheet 5*g* under tension. The recording material-carrying sheet 5*g* may be formed of a sheet of dielectric material, such as a polycarbonate film. The transfer device 5 is organized to carrying a recording material about the transfer drum 5*a* surface by adsorption.

The cleaning device 6 includes a cleaning blade 6*a* for scraping down residual toner remaining on the photosensitive drum 1 surface without being transferred onto the recording material P, and a cleaning vessel 6*b* for recovering the residual toner thus scraped down.

The pre-exposure lamp 7 is disposed upstream of the primary charger 2 so as to remove unnecessary charge remaining on the photosensitive drum 1 surface after cleaning by the cleaning device 6.

The paper supply and conveying unit 8 includes a plurality of paper supply cassettes loaded with different sizes of recording material P, paper supply rollers 8*b* for supplying the recording materials P in the paper supply cassettes 8*a*, a number of conveyance rollers (not numbered) and a register roller 8*c* for supplying a prescribed size of recording materials P to the transfer drum 5*a*.

The separation means 9 includes a separation charger 9*a* and a separation claw 9*b* for separating a recording material P having received a transferred toner image from the transfer drum 5*a*, and a separation and push-up roller 9*c*.

The heat-pressure fixing device 10 includes a fixing roller 10*a* equipped with an internal heater, and a pressure roller 10*b* for pushing the recording material P against the fixing roller 10*a*.

The paper discharge unit 11 disposed generally below the heat-pressure fixing device 10, includes a conveyance path-switching guide 11*a*, discharger rollers 11*b* and a paper discharge tray 11*c*. Below the conveyance path-switching guide 11*a* are disposed a conveyance vertical path 11*d*, an inversion path 11*e*, loading members 11*f*, an intermediate tray 11*g*, conveyance rollers 11*h* and 11*i*, and inversion rollers 11*j*, etc.

Between the primary charger 2 and the developing apparatus 4 along the photosensitive drum 1 surface, a potential sensor S1 for detecting a charged potential on the photosensitive drum 1 surface is disposed, and a density sensor S2 for detecting a toner image concentration on the photosensitive drum 1 is disposed between the developing apparatus 4 and the transfer drum 5*a*.

Now, the reader unit II is described. The reader unit II disposed above the printer unit I includes an original glass stage 12*a* on which an original D is placed, an exposure lamp 12 for scanningly illuminating the image surface of the original D while moving thereabove, a plurality of mirrors 12*c* for further reflecting the reflected light from the original D, lenses 12*d* for condensing the reflected light and a full color sensor 12*e* for forming color separation image signals based on light from the lenses 12*d*. The color separation image signals are sent via an amplifying circuit (not shown) to a video processor unit (not shown), from which processed signals are supplied to the above-mentioned printer unit I.

Now, the operation of the above-mentioned image forming apparatus will be described. In this embodiment, a full color image is formed by sequential development of yellow, cyan, magenta and black images.

An image of the original D placed on the original glass stage 12*a* in the reader unit II is illuminated by the exposure light 12*b* and color-separated into separated color signals, of which a yellow image signal is first read and processed by a full-color sensor 12*e*, from which a processed yellow image signal is sent to the printer unit I.

In the printer unit I, the photosensitive drum 1 is driven in rotation in the arrow R1 direction and uniforming surface-charged by the primary charger 2 (charging step). Based on the image signal supplied from the reader unit II, a laser beam is emitted from a laser unit of the exposure means 3 and sent via the polygonal mirror 3*a*, etc., to illuminate the charged photosensitive drum 1 surface with a light image E. The exposed portion of the photosensitive drum 1 surface is charge-removed to form an electrostatic image corresponding to the yellow image signal (latent image forming step). In the developing apparatus 4, the yellow developing device 4Y is disposed in the prescribed developing position, and the other developing devices 4C, 4M and 4B*k* are caused to retreat from their developing positions. The electrostatic latent image on the photosensitive drum 1 is developed by attachment with yellow toner in the yellow developing device 4Y to form a yellow toner image thereon (developing step). The yellow toner image on the photosensitive drum 1 is then transferred onto a recording material P carried on the transfer drum 5*a*. The recording material P is supplied from a paper supply cassette 8*a* having therein a prescribed size of recording materials P corresponding to the original image size via paper supply rollers 8*b*, conveyance rollers and the register roller 8*c* to the transfer drum 5*a* at a prescribed timing. The thus-supplied recording material P supplied to the transfer drum 5*a* is adsorbed thereon to be wound about the surface thereof and rotated in the arrow 5R direction, while the yellow toner image on the photosensitive drum 1 is transferred onto the recording material P under the action of the transfer charger 5*b* (transfer step).

The photosensitive drum 1 after the transfer of the yellow toner image is subjected to cleaning by the cleaning device 6 for removing the residual toner from the surface thereof and charge-removed by the pre-exposure lamp 7 to be recycled to a subsequent image forming cycle for cyan image formation starting from the primary charging.

The above-mentioned process cycle starting with the reading of the original image by the reader unit II, and including the transfer of a toner image onto the recording material P on the transfer drum 5*a* and further the cleaning and charge-removal of the photosensitive drum is repeated similarly with other colors of cyan, magenta and black than yellow, so that 4 color toner images of yellow toner, cyan toner, magenta toner and black toner are transferred in superposition onto the recording material P on the transfer drum 5*a*.

The recording material P having received the transferred four-color toner images is separated from the transfer drum 5*a* by means of the separation charger 9*a*, the separation claw 9*b*, etc., and then sent to the fixing device 10 while carrying the yet-unfixed toner images on the surface thereof. Then, the recording material P is heated under pressure by the fixing roller 10*a* and the pressure roller 10*b* in the heat-pressure fixing device 10, whereby the color toner images are melted and fixed to form a full-color image on one surface of the recording material P (fixing step). The recording material P carrying the fixed full-color image after the fixing step is discharged by the discharge rollers 11*b* onto the discharge paper tray 11C.

In the above, the formation of a full-color image on one surface of recording material P has been described. Then, a method of forming full-color images on both surfaces of a recording material is described with reference to FIG. 1.

In the case of forming full-color images on both surfaces of a recording material P, a recording material P discharged out of the heat-pressure fixing device 10 and carrying a fixed full-color image on its one surface is immediately driven by the conveyance pass-switching guide 11*a* to be guided once to the inversion path 11*e* and caused to retract therefrom in the reverse order by the inversion rollers 11*j* and enter the intermediate tray 11*g* with its trailing end as now the leading end. Then, the recording material having the full-color image on its one surface in the intermediate tray 11*g* is sent to and held on the transfer drum 5*a* for receiving transfer of color toner images of yellow toner, cyan toner, magenta toner and black toner on the other surface through the above-mentioned image forming process cycles.

The recording material P thus carrying unfixed color toner images on the other surface is then separated from the transfer drum 5*a* and again sent to the heat-pressure fixing device 10 whereby the unfixed toner images are heat-fixed under pressure onto the other surface, thus providing fixed full-color images on both surfaces of the recording material P.

Cleaning may be performed, as desired, by using a fur brush 13*a*, a backup brush 13*b*, an oil-removing roller 14*a* and a backup brush 14*b*. Such cleaning may be performed as desired before or after image formation, or as desired when paper jamming occurs.

As described above, the resin-coated carrier according to the present invention is formed by coating carrier core particles of a specific ferrite composition uniformly with a very thin and smooth resin coating layer, thus providing a two-component developer with a very good flowability and quick and uniform toner charging performance. The resin-coated carrier and two-component developer of the present invention can provide high-quality images for a long period in various environments.

EXAMPLES

Hereinbelow, the present invention will be described more specifically based on Examples, wherein "parts" for describing compositions are by weight.

Carrier Core Production Examples 1–14

For preparation of each carrier core, the respective oxides indicated in Table 1 were blended and ground for 6 hours in a wet-type ball mill, then dried and calcined at 800° C. Thereafter, the calcined product was ground for hours within a wet-type ball mill into a slurry of ca. 2 $\mu$m in dispersed particle size, and a dispersant and a binder were added thereto, followed by forming into particles and drying in a spray drier. Then, the particles were calcined at 1200° C. or higher in an electric furnace while controlling the oxygen concentration, disintegrated and classified pneumatically.

The respective carrier cores thus prepared exhibited the composition shown in Table 1 as a result of ICE-APS in the above-described manner.

Carrier Production Examples 1–18

Carrier cores 1–14 prepared in the above-described manner were subjected to coating with a solution in toluene of a silicone resin ("SR2410", mfd. by Toray Dow Corning Co.) in a fluidized bed to prepare Carriers 1–17 represented by parameters shown in Table 2 below.

TABLE 1

| Carrier core | Carrier core: Composition (mol. %) $Fe_2O_3$ | MnO | MgO | SrO | CaO | $Al_2O_3$ | $SiO_2$ |
|---|---|---|---|---|---|---|---|
| 1 | 52.0 | 38.1 | 8.8 | 0.7 | 0.2 | 0.1 | 0.1 |
| 2 | 51.5 | 57.5 | 9.7 | 0.5 | 0.5 | 0.2 | 0.1 |
| 3 | 52.0 | 39.1 | 7.4 | 0.7 | 0.31 | 0.3 | 0.19 |
| 4 | 52.5 | 37.6 | 9.0 | 0.50 | 0.2 | 0.1 | 0.06 |
| 5 | 51.8 | 38.6 | 8.9 | 0.3 | 0.2 | 0.2 | — |
| 6 | 48.0 | 38.8 | 11.8 | 0.5 | 0.5 | 0.3 | 0.1 |
| 7 | 55.9 | 35.6 | 7.5 | 0.6 | 0.2 | 0.1 | 0.1 |
| 8 | 50.0 | 35.0 | 10.0 | 5.0 | — | — | — |
| 9 | 45.0 | 40.0 | 8.0 | — | 7.0 | — | — |
| 10 | 49.0 | 37.0 | 10.0 | — | — | 4.0 | — |
| 11 | 47.0 | 35.0 | 7.0 | 6.0 | — | — | 5.0 |
| 12 | 52.1 | 37.1 | 6.3 | 2.1 | 2.1 | 0.2 | 0.1 |
| 13 | 52.1 | 37.1 | 6.3 | 0.1 | 0.2 | 2.0 | 2.2 |
| 14 | 60.5 | 25.9 | 13.0 | 0.1 | 0.1 | 0.1 | 0.3 |

TABLE 2

| Carrier | Carrier core | Coated carrier: Coating resin (wt. %) | S1 (= SBET) ($cm^2/g$) | Paraticle size distribution: Average D ($\mu$m) | ≦21 $\mu$m (Vol. %) | ≧72 $\mu$m (Vo. %) | ρ ($g/cm^3$) | S1/(ρ/D) |
|---|---|---|---|---|---|---|---|---|
| 1 | 1 | 0.10 | 950 | 38 | 2.6 | 2.5 | 3.81 | 0.948 |
| 2 | 1 | 0.125 | 965 | 38 | 2.6 | 2.5 | 3.81 | 0.962 |
| 3 | 1 | 0.08 | 930 | 38 | 2.6 | 2.5 | 3.81 | 0.927 |
| 4 | 2 | 0.12 | 870 | 43.2 | 3.5 | 3.5 | 3.76 | 1.00 |
| 5 | 3 | 0.11 | 990 | 35.2 | 5.8 | 0.5 | 3.89 | 0.895 |
| 6 | 4 | 0.125 | 760 | 50.1 | 1.6 | 5.0 | 3.84 | 0.991 |
| 7 | 5 | 0.15 | 850 | 54 | 2.9 | 4.1 | 3.85 | 1.19 |
| 8 | 6 | 0.125 | 570 | 38 | 1.1 | 5.9 | 3.72 | 0.58 |
| 9 | 7 | 0.08 | 970 | 37 | 2.8 | 3.9 | 3.88 | 0.925 |
| 10 | 8 | 0.15 | 1320 | 45 | 3.9 | 8.0 | 3.82 | 1.555 |
| 11 | 9 | 0.05 | 550 | 32 | 7.5 | 7.9 | 3.83 | 0.459 |
| 12 | 10 | 0.50 | 990 | 53 | 10.5 | 6.5 | 3.84 | 1.366 |
| 13 | 11 | 0.12 | 1120 | 44 | 6.4 | 8.4 | 3.82 | 1.29 |
| 14 | 1 | 0.01 | 870 | 38 | 2.6 | 2.5 | 3.81 | 0.868 |
| 15 | 2 | 15.0 | 985 | 37 | 3.2 | 3.5 | 3.71 | 0.982 |
| 16 | 12 | 0.9 | 1300 | 22.5 | 9.5 | 0.1 | 3.92 | 0.746 |
| 17 | 13 | 0.1 | 380 | 65 | 2.0 | 15.3 | 3.90 | 0.633 |
| 18 | 14 | 0.15 | 1210 | 39 | 2.1 | 4.5 | 3.94 | 1.198 |

Toner Production Examples

| Toner 1 | |
|---|---|
| Polyester resin (condensation product between propoxidized bisphenol and fumaric acid) | 100 parts |
| Phthalocyanine pigment (C.I. Pigment Blue 15:3) | 4 " |
| Di-t-butylsalicylic acid Al complex | 4 " |

The above ingredients were sufficiently preliminarily blended in a Henschel mixer and then melt-kneaded through a twin-screw extruder. After cooling, the kneaded product was coarsely crushed to ca. 1–2 mm by a hammer mill and then finely pulverized by an air jet pulverizer. The pulverized product was classified to obtain negatively chargeable cyan toner particles having a weight-average particle size (D4) of 6.8 μm and containing 12% by number of particles of 4.0 μm or smaller and 15% by volume of particles of 8.0 μm or larger.

100 parts of the cyan toner particles were blended with 1.0 part of hydrophobic alumina fine powder (D1=20 nm) hydrophobized with isobutyltrimethoxysilane to obtain Toner 1 characterized by parameter shown in Table 3 below.

Toner 2

100 parts of the above-prepared cyan toner particles were blended with hydrophobized titanium oxide fine powder (D1=30 nm) hydrophobized with n-butyltrimethoxysilane to obtain Toner 2 characterized by parameters shown in Table 3.

Toners 3 and 4

Toners 3 and 4 as shown in Table 3 were prepared respectively in the same manner as in the production of Toner 1 except for changing the classification conditions, followed by similar external blending with the hydrophobic alumina fine powder.

Toners 5, 6 and 7

Toners 5, 6 and 7 (of magenta, yellow and black, respectively) having properties as shown in Table 3 were prepared by repeating the procedure for production of Toner 1 above except for using C.I. Pigment Red 122, C.I. Pigment Yellow 17 and carbon black, respectively, instead of the phthalocyanine pigment.

using an original having an areal image percentage of 20% first on 5000 sheets, followed by standing for 10 days and then continuous image formation on 1000 sheets (totally 6000 sheets). Separately, in a low-humidity environment of 23° C./5% RH, continuous image formation was performed on 10,000 sheets. The performance evaluation was performed with respect to image density, fog, highlight reproducibility and soiling of the optical toner concentration detector. The results are inclusively shown in Table 4 together with those of the following Examples and Comparative Examples.

Examples 2–12

Two-component developers were prepared as combinations of Toners and Carriers shown in Table 4 and evaluated in the same manner as in Example 1, whereby similarly good results as in Example 1 were obtained in general while detailed results are shown in Table 4.

Comparative Example 1

A two-component developer was prepared by combination of Toner 1 and Carrier 10 and evaluated otherwise in the same manner as in Example 1. As a result, in the low-humidity environment, fog increased as the continuation of image formation. In the high-humidity environment, fog and toner scattering were observed, and in the image formation after the standing, some image density lowering was observed presumably attributable to mal-detection of toner concentration due to soiling of the optical toner concentration detector which was confirmed by inspection after the continuous image formation.

TABLE 3

| | Toner | | | | | | | | |
|---|---|---|---|---|---|---|---|---|---|
| | | | | Particle size distribution | | | | | |
| | Inorganic fine powder | | | Toner particles | | | Toner | | |
| Toner | material | D1 (nm) | amount (part) | D4 (μm) | ≦4.0 μm (N %) | ≧8.0 μm (Vol. %) | D4 (μm) | ≦4.0 μm (N %) | ≧8.0 μm (Vol. %) |
| 1 | $Al_2O_3$ | 20 | 1.0 | 6.8 | 12 | 15 | 6.8 | 12 | 15 |
| 2 | $TiO_2$ | 30 | 1.0 | 6.8 | 12 | 15 | 6.8 | 12 | 15 |
| 3 | $Al_2O_3$ | 20 | 1.0 | 53 | 38.7 | 5 | 5.3 | 38.8 | 5 |
| 4 | " | 20 | 1.0 | 9.4 | 18.9 | 39 | 9.8 | 12 | 18.9 |
| 5 | " | 20 | 1.0 | 6.8 | 10 | 12 | 6.8 | 10 | 12 |
| 6 | " | 20 | 1.0 | 6.9 | 9 | 13 | 6.9 | 9 | 13 |
| 7 | " | 20 | 1.0 | 7.5 | 8 | 10 | 7.5 | 8 | 10 |

Example 1

The above-prepared Toner 1 and Carrier 1 were blended with each other to prepare a two-component developer having a toner concentration of 8 wt. %, and charged in an image forming apparatus having a structure as shown in FIG. 1 (a full-color copying machine "CLC730", mfd. by Canon K.K.).

Figure 2:
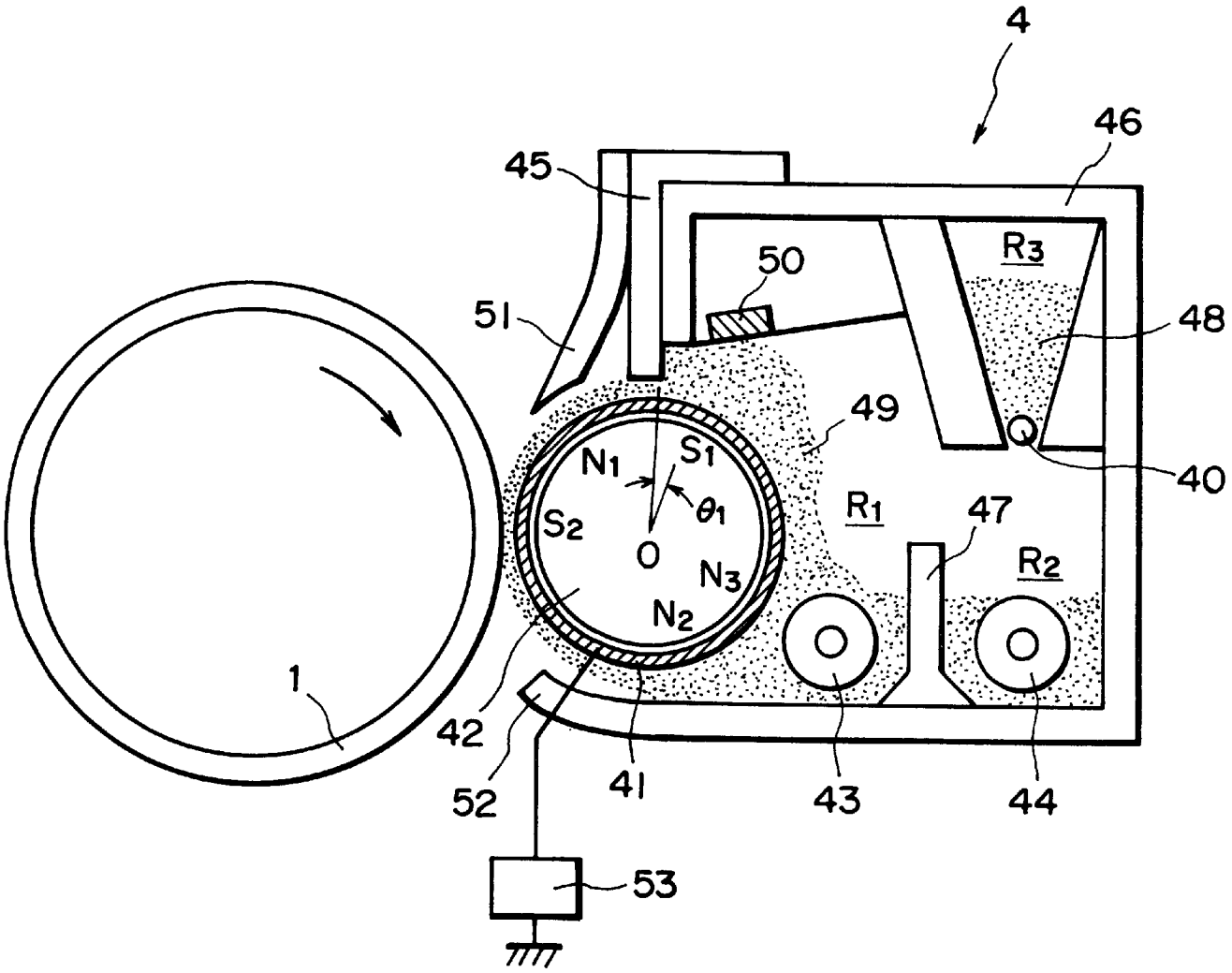
FIG. 2 illustrates an organization of a developing device suitably incorporated in such an image forming apparatus.

Then, continuous image formation was performed in the following manner while replenishing the toner as desired so as to maintain the toner concentration of 8 wt. % based on detection results by an optical toner concentration detection member 50 (FIG. 2). In a high-humidity environment of 30° C./90% RH, continuous image formation was performed by Comparative Example 2

A two-component developer was prepared by combination of Toner 1 and Carrier 11 and evaluated otherwise in the same manner as in Example 1. As a result, in the low-humidity environment, fog was noticeable compared with Example 1. In the high-humidity environment, the highlight reproducibility was inferior, and in the image formation after the standing, some soiling of the optical toner concentration detector resulting in a slight lowering in image density was observed, as confirmed by inspection after the continuous image formation.

Comparative Example 3

A two-component developer was prepared by combination of Toner 1 and Carrier 12 and evaluated otherwise in the same manner as in Example 1. As a result, in the low-humidity environment, fog increased as the continuation of image formation. In the high-humidity environment, fog and toner scattering were observed, and in the image formation after the standing, some image density lowering due to soiling of the optical toner concentration detector was observed, as confirmed by inspection after the continuous image formation.

Comparative Example 4

A two-component developer was prepared by combination of Toner 1 and Carrier 13 and evaluated otherwise in the same manner as in Example 1. As a result, in the low-humidity environment, fog increased as the continuation of image formation. In the high-humidity environment, fog and toner scattering were observed, and in the image formation after the standing, some image density lowering due to soiling of the optical toner concentration detector was observed, as confirmed by inspection after the continuous image formation.

Comparative Example 5

A two-component developer was prepared by combination of Toner 1 and Carrier 14 and evaluated otherwise in the same manner as in Example 1. As a result, image density was low and fog was noticeable due to insufficient carrier coating. As a result of inspection after the continuous image formation, soiling on the detection window of the optical toner concentration detector was observed.

Comparative Example 6

A two-component developer was prepared by combination of Toner 1 and Carrier 15 and evaluated otherwise in the same manner as in Example 1. As a result, fog was severe from the initial stage and also tended to increase as the continuation of the image formation. Presumably due to an excessive coating amount, some agglomerates of the coating material were observed in the carrier, which appeared to have resulted in charging failure. As a result of inspection after the continuous image formation, soiling on the detection window of the optical toner concentration detector was observed.

Comparative Example 7

A two-component developer was prepared by combination of Toner 1 and Carrier 16 and evaluated otherwise in the same manner as in Example 1. As a result, fog was severe from the initial stage and increased with the continuation of image formation, and the highlight reproducibility was also remarkably lowered. As a result of inspection after the continuous image formation, soiling on the detection window of the optical toner concentration detector was observed. As a result of inspection after the continuous image formation, soiling on the detection window of the optical toner concentration detector was observed.

Comparative Example 8

A two-component developer was prepared by combination of Toner 1 and Carrier 17 and evaluated otherwise in the same manner as in Example 1. As a result, the image density was low, and the highlight reproducibility was far from a satisfactory level. As a result of inspection after the continuous image formation, soiling on the detection window of the optical toner concentration detector was observed. The soiling was especially noticeable after the continuous image formation after the standing in the high humidity environment.

Comparative Example 9

A two-component developer was prepared by combination of Toner 1 and Carrier 18 and evaluated otherwise in the same manner as in Example 1. As a result, compared with Example 1, fog tended to increase with increase in number of copied sheets. Further, in the image formation after the tanding in the high humidity environment, some density lowering was observed presumably due to soiling of the optical toner concentration detector as confirmed by inspection after the continuous image formation.

TABLE 4

Performance evaluation results

| | | | 23° C./5% RH | | | | | | | 30° C./90% RH | | | | | | | | | | |
|---|---|---|---|---|---|---|---|---|---|---|---|---|---|---|---|---|---|---|---|---|
| | | | | | | After 10000 sheets | | | | | | | After 5000 sheets | | | | After 6000 sheets (1000 sheets after standing) | | | |
| Example | Carrier | Toner | Initial I.D. | Initial Fog (%) | Initial Highlight | I.D. | Fog (%) | Highlight | Detector soil | Initial I.D. | Initial Fog (%) | Initial Highlight | I.D. | Fog (%) | Highlight | Detector soil | I.D. | Fog (%) | Highlight | Detector soil |
| 1 | 1 | 1 | 1.75 | 0.3 | A | 1.71 | 0.6 | A | A | 1.82 | 0.4 | A | 1.79 | 0.5 | A | A | 1.85 | 0.7 | A | A |
| 2 | 2 | 1 | 1.72 | 0.5 | A | 1.68 | 0.7 | A | A | 1.83 | 0.4 | A | 1.78 | 0.5 | A | A | 1.84 | 0.8 | A | A |
| 3 | 3 | 1 | 1.76 | 0.4 | A | 1.7 | 0.7 | A | A | 1.83 | 0.4 | A | 1.8 | 0.5 | A | A | 1.84 | 0.8 | A | A |
| 4 | 4 | 1 | 1.70 | 0.3 | A | 1.63 | 0.8 | A | A | 1.82 | 0.5 | A | 1.76 | 0.5 | A | A | 1.83 | 0.8 | A | A |
| 5 | 5 | 1 | 1.65 | 0.4 | A | 1.61 | 0.9 | A | A | 1.82 | 0.5 | A | 1.75 | 0.6 | A | A | 1.82 | 0.9 | A | A |
| 6 | 6 | 1 | 1.68 | 0.4 | A | 1.63 | 0.9 | A | A | 1.84 | 0.5 | A | 1.74 | 0.7 | A | A | 1.86 | 0.8 | A | A |
| 7 | 7 | 1 | 1.71 | 0.4 | A | 1.65 | 1.2 | B | B | 1.81 | 0.6 | A | 1.78 | 0.6 | B | A | 1.84 | 0.9 | B | A |
| 8 | 8 | 1 | 1.74 | 0.4 | A | 1.64 | 0.6 | A | A | 1.83 | 0.6 | B | 1.78 | 0.9 | B | A | 1.90 | 1.1 | B | B |

TABLE 4-continued

| Example | Carrier | Toner | 23° C./5% RH Initial I.D. | Fog (%) | High-light | After 10000 sheets I.D. | Fog (%) | High-light | Detector soil | 30° C./90% RH Initial I.D. | Fog (%) | High-light | After 5000 sheets I.D. | Fog (%) | High-light | Detector soil | After 6000 sheets (1000 sheets after standing) I.D. | Fog (%) | High-light | Detector soil |
|---|---|---|---|---|---|---|---|---|---|---|---|---|---|---|---|---|---|---|---|---|
| 9 | 9 | 1 | 1.71 | 0.4 | A | 1.64 | 0.7 | A | A | 1.82 | 0.5 | A | 1.78 | 0.6 | A | A | 1.82 | 0.9 | B | A |
| 10 | 1 | 2 | 1.76 | 0.3 | A | 1.72 | 0.6 | A | A | 1.82 | 0.4 | A | 1.79 | 0.6 | A | A | 1.83 | 0.8 | A | A |
| 11 | 1 | 3 | 1.79 | 0.6 | A | 1.68 | 1.4 | A | A | 1.88 | 0.6 | A | 1.79 | 0.8 | A | A | 1.81 | 1.2 | B | A |
| 12 | 1 | 4 | 1.64 | 0.5 | A | 1.63 | 0.8 | B | A | 1.79 | 0.2 | A | 1.72 | 0.6 | A | A | 1.89 | 0.9 | B | A |
| Comp. 1 | 10 | 1 | 1.62 | 1.0 | A | 1.28 | 3.4 | D | C | 1.85 | 1.5 | C | 1.52 | 3.3 | E | C | 1.21 | 0.9 | E | E |
| Comp. 2 | 11 | 1 | 1.61 | 0.7 | B | 1.45 | 2.6 | C | B | 1.82 | 0.9 | C | 1.62 | 2.7 | D | B | 1.42 | 3.0 | E | C |
| Comp. 3 | 12 | 1 | 1.58 | 1.3 | B | 1.19 | 3.2 | D | C | 1.79 | 1.7 | C | 1.45 | 3.8 | E | C | 1.25 | 1.6 | E | E |
| Comp. 4 | 13 | 1 | 1.75 | 1.1 | B | 1.34 | 3.5 | D | C | 1.82 | 1.3 | C | 1.51 | 3.4 | E | C | 1.23 | 4.1 | E | E |
| Comp. 5 | 14 | 1 | 1.45 | 2.5 | C | 1.20 | 4.5 | D | E | 1.56 | 3.1 | C | 1.31 | 5.2 | E | C | 1.20 | 8.4 | E | E |
| Comp. 6 | 15 | 1 | 1.56 | 3.1 | B | 1.25 | 4.8 | D | E | 1.72 | 3.9 | C | 1.60 | 5.4 | E | C | 1.27 | 6.2 | E | E |
| Comp. 7 | 16 | 1 | 1.71 | 3.5 | A | 1.40 | 4.5 | C | E | 1.88 | 3.1 | B | 1.60 | 5.5 | D | D | 1.39 | 7.2 | E | E |
| Comp. 8 | 17 | 1 | 1.46 | 0.7 | C | 1.30 | 2.4 | D | C | 1.60 | 1.9 | C | 1.53 | 2.1 | E | B | 1.21 | 2.4 | E | E |
| Comp. 9 | 18 | 1 | 1.62 | 0.9 | B | 1.33 | 2.8 | D | C | 1.82 | 1.3 | C | 1.53 | 3.4 | D | C | 1.34 | 3.8 | D | D |

Evaluation Methods

Evaluation results shown in Table 4 above indicate results of evaluation according to the following methods and standards.

Image Density (I.D.)

A maximum density was measured by using a Macbeth densitometer (available from Macbeth Co.)

Fog

A reflectance D (%) of standard white plain paper and a reflectance Ds (%) at non-image part on the standard white plain paper after image formation thereon were respectively measured by using a reflective densitometer ("REFLECTOMETER MODEL TC-6DS", mfd. by Tokyo Denshoku K.K.) while using an amber filter for cyan toner images. The fog (%) value was calculated by the following equation:

$$\text{Fog } (\%) = Ds - Dr.$$

A smaller value represents less fog.

Highlight (Reproducibility)

A copied image formed as a reproduction of an original image having an image density of 0.5 was observed with eyes and evaluated according to the following standard.

A: Good images were obtained with a uniform image density and excellent thin-line reproducibility.

B: Copied images were somewhat inferior in uniformity.

C: Copied images were accompanied with image density irregularity and with a recognizable difference in thickness of thin lines.

D: Copied images were accompanied with remarkable image density irregularities and a remarkable difference in thickness of thin lines.

E: Copied images were accompanied with a maximum level of image density irregularities and reproduced thin lines did not allow thickness evaluation.

Detector Soiling

The soiling of the toner concentration detection member (window) was observed with eyes and evaluated according to the following standard.

A: No toner attachment at all.

B: Almost no toner attachment.

C: Some toner attachment was observed but at a practically acceptable level.

D: Toner attachment was observed to a level of causing mal-detection at a high possibility.

E: Remarkable toner attachment observed.

Example 13

Magenta developer, Yellow developer and Black developer each of a two component type developer were prepared by blending Toner 5 (magenta), Toner 6 (yellow) and Toner 7 (black), respectively, with Carrier 1 so as to provide toner concentrations of 8 wt. %, 8 wt. % and 6 wt. %, respectively.

Cyan developer prepared in Example 1 and the above-prepared Magenta, Yellow and Black developers were charged in a cyan developing device 4C, a magenta developing device 4M, a yellow developing device 4Y and a black developing deice 4B*k*, respectively, of a commercially available full-color copying machine ("CLC730", mfd. by Canon K.K.) and subjected to full-color image formation in a manner as described with reference to FIG. 1.

As a result, good images were formed with a good highlight reproducibility. The images exhibited good reproducibility of halftones of green and red (as secondary colors) whereby human skin colors were reproduced at a very good level. Further, as a result of continuous image formation tests in low and high humidity environments as in Example 1, good image quality was retained.

What is claimed is:

1. A resin-coated carrier, comprising: carrier core particles and 0.01–2.0 wt. % based on the carrier core particles of a resin coating layer coating the carrier core particles, wherein the carrier core particles comprise a ferrite component represented by formula (I) below:

$$(Fe_2O_3)_a(MnO)_b(MgO)_c(A)_d \quad \text{(I)},$$

wherein A represents a mixture of SrO, CaO and $Al_2O_3$, and a, b, c and d are numbers representing mol fractions of associated components and satisfying: $0.4<a<0.6$, $0.35<b<0.45$, $0.07<c<0.12$, $0.005<d<0.015$, and $a+b+c+d\leqq 1$, and the resin-coated carrier has an average particle size of 25–55 μm.

2. The resin-coated carrier according to claim 1, wherein the carrier core particles are surface-coated with the resin coating layer in an amount of 0.05–1.0 wt. % based on the carrier core particles.

3. The resin-coated carrier according to claim 1, wherein the carrier core particles are surface-coated with the resin coating layer in an amount of 0.05–0.5 wt. % based on the carrier core particles.

4. The resin-coated carrier according to claim 1, wherein the carrier core particles are surface-coated with the resin coating layer in an amount of 0.07–0.3 wt. % based on the carrier core particles.

5. The resin-coated carrier according to claim 1, wherein the resin-coated carrier has an average particle size of 30–55 μm.

6. The resin-coated carrier according to claim 1, wherein the resin-coated carrier has an average particle size of 30–50 μm.

7. The resin-coated carrier according to claim 1, wherein the resin-coated carrier has an average particle size of 35–45 μm.

8. The resin-coated carrier according to claim 1, wherein the ferrite component is represented by formula (II) below:

$$(Fe_2O_3)_a(MnO)_b(MgO)_c(A)_d(SiO_2)_e \quad \text{(II)},$$

wherein A represents a mixture of SrO, CaO and $Al_2O_3$, and a, b, c, d and e are numbers representing mol fractions of associated components and satisfying: $0.4<a<0.6$, $0.35<b<0.45$, $0.07<c<0.12$, $0.005<d<0.015$, $0.0005<e<0.002$ and $a+b+c+d+e\leqq 1$.

9. The resin-coated carrier according to claim 1, wherein the resin-coated carrier has such a particle size distribution as to provide an average particle size of 25–55 μm and contain at most 6.0% by volume of particles of 21 μm or smaller and at most 6.0% by volume of particles of 72 μm or larger.

10. The resin-coated carrier according to claim 1, wherein the resin-coated carrier has a surface smoothness as represented by a relationship of $$0.5\leqq S1/(\rho/D)\leqq 1.2$$

among a BET specific surface area S1 ($cm^2/g$), an average particle size D (cm) and a true specific gravity $\rho(g/cm^3)$, respectively, of the resin-coated carrier.

11. The resin-coated carrier according to claim 1, wherein the resin-coated carrier has a resin coating rate as represented by a relationship of $$D/500\leqq W\leqq D/300,$$

between the average particle size D (μm) and resin coating weight per weight of the carrier core W (wt. %).

12. The resin-coated carrier according to claim 1, wherein the resin-coated carrier has such a particle size distribution as to provide an average particle size of 25–55 μm and contain at most 6.0% by volume of particles of 21 μm or smaller and at most 6.0% by volume of particles of 72 μm or larger, a surface smoothness as represented by a relationship of $$0.5\leqq S1/(\rho/D)\leqq 1.2$$

among a BET specific surface area S1 ($cm^2/g$), an average particle size D (cm) and a true specific gravity $\rho(g/cm^3)$, respectively, of the resin-coated carrier, and also a resin coating rate as represented by a relationship of $$D/500\leqq W\leqq D/300,$$

between the average particle size D (μm) and resin coating weight per weight of the carrier core W (wt. %).

13. The two-component developer, comprising: a toner and a resin-coated carrier, wherein the resin-coated carrier comprises carrier core particles and 0.01–2.0 wt. % based on the carrier core particles of a resin coating layer coating the carrier core particles, the carrier core particles comprise a ferrite component represented by formula (I) below:

$$(Fe_2O_3)_a(MnO)_b(MgO)_c(A)_d \quad \text{(I)},$$

wherein A represents a mixture of SrO, CaO and $Al_2O_3$, and a, b, c and d are numbers representing mol fractions of associated components and satisfying: $0.4<a<0.6$, $0.35<b<0.45$, $0.07<c<0.12$, $0.005<d<0.015$, and $a+b+c+d\leqq 1$, and the resin-coated carrier has an average particle size of 25–55 μm.

14. The two-component developer according to claim 13, wherein the carrier core particles are surface-coated with the resin coating layer in an amount of 0.05–1.0 wt. % based on the carrier core particles.

15. The two-component developer according to claim 13, wherein the carrier core particles are surface-coated with the resin coating layer in an amount of 0.05–0.5 wt. % based on the carrier core particles.

16. The two-component developer according to claim 13, wherein the carrier core particles are surface-coated with the resin coating layer in an amount of 0.07–0.3 wt. % based on the carrier core particles.

17. The two-component developer according to claim 13, wherein the resin-coated carrier has an average particle size of 30–55 μm.

18. The two-component developer according to claim 13, wherein the resin-coated carrier has an average particle size of 30–50 μm.

19. The two-component developer according to claim 13, wherein the resin-coated carrier has an average particle size of 35–45 μm.

20. The two-component developer according to claim 13, wherein the ferrite component is represented by formula (II) below:

$$(Fe_2O_3)_a(MnO)_b(MgO)_c(A)_d(SiO_2)_e \quad \text{(II)},$$

wherein A represents a mixture of SrO, CaO and $Al_2O_3$, and a, b, c, d and e are numbers representing mol fractions of associated components and satisfying: $0.4<a<0.6$, $0.35<b<0.45$, $0.07<c<0.12$, $0.005<d<0.015$, $0.0005<e<0.002$ and $a+b+c+d+e\leqq 1$.

21. The two-component developer according to claim 13, wherein the resin-coated carrier has such a particle size distribution as to provide an average particle size of 25–55 μm and contain at most 6.0% by volume of particles of 21 μm or smaller and at most 6.0% by volume of particles of 72 μm or larger.

22. The two-component developer according to claim 13, wherein the resin-coated carrier has a surface smoothness as represented by a relationship of $$0.5\leqq S1/(\rho/D)\leqq 1.2$$

among a BET specific surface area S1 ($cm^2/g$), an average particle size D (cm) and a true specific gravity $\rho(g/cm^3)$, respectively, of the resin-coated carrier.

23. The two-component developer according to claim 13, wherein the resin-coated carrier has a resin coating rate as represented by a relationship of $$D/500\leqq W\leqq D/300,$$

between the average particle size D (μm) and resin coating weight per weight of the carrier core W (wt. %).

24. The two-component developer according to claim 13, wherein the resin-coated carrier has such a particle size distribution as to provide an average particle size of 25–55 μm and contain at most 6.0% by volume of particles of 21 μm or smaller and at most 6.0% by volume of particles of 72 μm or larger, a surface smoothness as represented by a relationship of $$0.5\leqq S1/(\rho/D)\leqq 1.2$$

among a BET specific surface area S1 ($cm^2/g$), an average particle size D (cm) and a true specific gravity $\rho(g/cm^3)$, respectively, of the resin-coated carrier, and also a resin coating rate as represented by a relationship of $$D/500\leqq W\leqq D/300,$$

between the average particle size D (μm) and resin coating weight per weight of the carrier core W (wt. %).

25. The two-component developer according to claim 13, wherein the toner has such a particle size distribution as to contain 5–40% by number of particles of 4 μm or smaller.

26. The two-component developer according to claim 13, wherein the toner has such a particle size distribution as to contain 2.0–20.0% by volume of particles of 8 μm or larger.

27. The two-component developer according to claim 13, wherein the toner has such a particle size distribution as to contain 5–40% by number of particles of 4 μm or smaller, and 2.0–20.0% by volume of particles of 8 μm or larger.

28. The two-component developer according to claim 27, wherein the toner has a weight-average particle size of 4.0–10.5 μm.

29. The two-component developer according to claim 13, wherein the toner comprises a binder resin and a colorant.

30. The two-component developer according to claim 29, wherein the toner is a negatively chargeable toner containing a polyester resin as the binder resin.

31. The two-component developer according to claim 30, wherein the negatively chargeable toner contains 0.1–10 wt. parts of a negative charge control agent per 100 wt. parts of the binder resin.

32. The two-component developer according to claim 13, wherein the two-component developer contains the toner in a concentration of 2–12 wt. % thereof.

33. The two-component developer according to claim 13, wherein the two-component developer contains the toner in a concentration of 3–9 wt. % thereof.

34. The two-component developer according to claim 13, wherein the toner comprises toner particles and an external additive of inorganic fine powder having a number-average particle size of 0.001–0.2 μm.

35. The two-component developer according to claim 34, wherein the inorganic fine powder is contained in a proportion of 0.5–5.0 wt. % of the toner particles.

36. An image forming method, comprising:

a latent image forming step of forming an electrostatic latent image on an image-bearing member, and a developing step of forming a layer of a two-component developer comprising a toner and a resin-coated carrier on a developer-carrying member, carrying and conveying the two-component developer together with the developer-carrying member to a developing region where the developer-carrying member is opposite to the image-bearing member, and developing the latent image on the image-bearing member with the toner in the two-component developer carried on the developer-carrying member in the developing region; wherein the resin-coated carrier comprises carrier core particles and 0.01–2.0 wt. % based on the carrier core particles of a resin coating layer coating the carrier core particles, wherein the carrier core particles comprise a ferrite component represented by formula (I) below:

$$(Fe_2O_3)_a(MnO)_b(MgO)_c(A)_d \quad \text{(I)},$$

wherein A represents a mixture of SrO, CaO and $Al_2O_3$, and a, b, c and d are numbers representing mol fractions of associated components and satisfying; $0.4<a<0.6$, $0.35<b<0.45$, $0.07<c<0.12$, $0.005<d<0.015$, and $a+b+c+d\leqq 1$, and the resin-coated carrier has an average particle size of 25–55 μm.

37. The image forming method according to claim 36, wherein the carrier core particles are surface-coated with the resin coating layer in an amount of 0.05–1.0 wt. % based on the carrier core particles.

38. The image forming method according to claim 36, wherein the carrier core particles are surface-coated with the resin coating layer in an amount of 0.05–0.5 wt. % based on the carrier core particles.

39. The image forming method according to claim 36, wherein the carrier core particles are surface-coated with the resin coating layer in an amount of 0.07–0.3 wt. % based on the carrier core particles.

40. The image forming method according to claim 36, wherein the resin-coated carrier has an average particle size of 30–55 μm.

41. The image forming method according to claim 36, wherein the resin-coated carrier has an average particle size of 30–50 μm.

42. The image forming method according to claim 36, wherein the resin-coated carrier has an average particle size of 35–45 μm.

43. The image forming method according to claim 36, wherein the ferrite component is represented by formula (II) below:

$$(Fe_2O_3)_a(MnO)_b(MgO)_c(A)_d(SiO_2)_e \quad \text{(II)},$$

wherein A represents a mixture of SrO, CaO and $Al_2O_3$, and a, b, c, d and e are numbers representing mol fractions of associated components and satisfying: $0.4<a<0.6$, $0.35<b<0.45$, $0.07<c<0.12$, $0.005<d<0.015$, $0.0005<e<0.002$ and $a+b+c+d+e \leqq 1$.

44. The image forming method according to claim 36, wherein the resin-coated carrier has such a particle size distribution as to provide an average particle size of 25–55 μm and contain at most 6.0% by volume of particles of 21 μm or smaller and at most 6.0% by volume of particles of 72 μm or larger.

45. The image forming method according to claim 36, wherein the resin-coated carrier has a surface smoothness as represented by a relationship of $$0.5 \leqq S1/(\rho/D) \leqq 1.2$$

among a BET specific surface area S1 ($cm^2/g$), an average particle size D (cm) and a true specific gravity $\rho(g/cm^3)$, respectively, of the resin-coated carrier.

46. The image forming method according to claim 36, wherein the resin-coated carrier has a resin coating rate as represented by a relationship of $$D/500 \leqq W \leqq D/300,$$

between the average particle size D (μm) and resin coating weight per weight of the carrier core W (wt. %).

47. The image forming method according to claim 36, wherein the resin-coated carrier has such a particle size distribution as to provide an average particle size of 25–55 μm and contain at most 6.0% by volume of particles of 21 μm or smaller and at most 6.0% by volume of particles of 72 μm or larger, a surface smoothness as represented by a relationship of $$0.5 \leqq S1/(\rho/D) \leqq 1.2$$

among a BET specific surface area S1 ($cm^2/g$), an average particle size D (cm) and a true specific gravity $\rho(g/cm^3)$, respectively, of the resin-coated carrier, and also a resin coating rate as represented by a relationship of $$D/500 \leqq W \leqq D/300,$$

between the average particle size D (μm) and resin coating weight per weight of the carrier core W (wt. %).

48. The image forming method according to claim 36, wherein the toner has such a particle size distribution as to contain 5–40% by number of particles of 4 μm or smaller.

49. The image forming method according to claim 36, wherein the toner has such a particle size distribution as to contain 2.0–20.0% by volume of particles of 8 μm or larger.

50. The image forming method according to claim 36, wherein the toner has such a particle size distribution as to contain 5–40% by number of particles of 4 μm or smaller, and 2.0–20.0% by volume of particles of 8 μm or larger.

51. The image forming method according to claim 50, wherein the toner has a weight-average particle size of 4.0–10.5 μm.

52. The image forming method according to claim 36, wherein the toner comprises a binder resin and a colorant.

53. The image forming method according to claim 52, wherein the toner is a negatively chargeable toner containing a polyester resin as the binder resin.

54. The image forming method according to claim 53, wherein the negatively chargeable toner contains 0.1–10 wt. parts of a negative charge control agent per 100 wt. parts of the binder resin.

55. The image forming method according to claim 36, wherein the two-component developer contains the toner in a concentration of 2–12 wt. % thereof.

56. The image forming method according to claim 36, wherein the two-component developer contains the toner in a concentration of 3–9 wt. % thereof.

57. The image forming method according to claim 36, wherein the toner comprises toner particles and an external additive of inorganic fine powder having a number-average particle size of 0.001–0.2 μm.

58. The image forming method according to claim 57, wherein the inorganic fine powder is contained in a proportion of 0.5–5.0 wt. % of the toner particles.

59. The image forming method according to claim 36, wherein in the developing step, the developer-carrying member is supplied with a DC/AC superposed bias voltage.

60. The image forming method according to claim 59, wherein the developer-carrying member comprises a developing sleeve and a magnet enclosed within the developing sleeve.

61. The image forming method according to claim 36, wherein the latent image forming step and the developing step are repeated by using two-component developers containing a yellow toner, a magenta toner, a cyan toner and a black toner, respectively, to form a full-color image.

* * * * *